United States Patent [19]

Imanishi et al.

[11] Patent Number: 5,028,917

[45] Date of Patent: Jul. 2, 1991

[54] IMAGE DISPLAY DEVICE

[75] Inventors: Yasuo Imanishi; Muneomi Hosokawa; Mieko Ariga, all of Tokyo, Japan

[73] Assignee: Yokogawa Medical Systems, Limited, Tokyo, Japan

[21] Appl. No.: 254,678

[22] PCT Filed: Feb. 27, 1987

[86] PCT No.: PCT/JP87/00129

§ 371 Date: Aug. 23, 1988

§ 102(e) Date: Aug. 23, 1988

[87] PCT Pub. No.: WO87/05428

PCT Pub. Date: Sep. 11, 1987

[30] Foreign Application Priority Data

Feb. 28, 1986 [JP] Japan ..... 61-43513

[51] Int. Cl.[5] ..... G09G 1/02

[52] U.S. Cl. ..... 340/793; 340/721

[58] Field of Search ..... 340/701, 729, 750, 793, 340/744, 721

[56] References Cited

U.S. PATENT DOCUMENTS 4,586,038 4/1986 Sims et al. ..... 340/729
4,658,247 4/1987 Gharachorloo ..... 340/750
4,688,190 8/1987 Bechtolsheim ..... 340/750
4,769,713 9/1988 Yasui ..... 340/793

FOREIGN PATENT DOCUMENTS 0148232 12/1973 Japan .
0095593 5/1985 Japan .
0188983 9/1985 Japan .

*Primary Examiner*—Alvin E. Oberley
*Attorney, Agent, or Firm*—Moonray Kojima

[57] ABSTRACT

This new invention provides a display device that displays data in multiple areas of the same screen in discrete ranges of gradation while minimizing increased hardware requirements. To apply our new invention in the most preferred application mode, we utilize an image display device that reads one frame of image data written to a first frame buffer (20) in repetition during the display cycle of the display unit (80). The display device writes image data each time to a write enable area of a second frame buffer (50) as specified by a write control circuit (40) after gradation conversion processing is executed using a gradation converting circuit (30). The image data of the second frame buffer is converted into a video signal by a video signal-generating circuit (70) and is displayed on the display unit (80). By repeatedly setting new gradations and write-enable areas, image data having discrete gradations for individual areas is written to the second frame buffer.

2 Claims, 4 Drawing Sheets

IMAGE DISPLAY DEVICE

TECHNICAL FIELD

This new invention is basically an improved image display device that displays gradient images, and more specifically, is an image display device that displays data in multiple areas on a display screen with discretely different ranges of gradation by matching the required range of image data gradation to the range of gradation for the display unit.

BACKGROUND ART

For an image display device that displays gradient images, the required range of gradation is usually selected from the range of gradation for the image data, and is displayed after being matched to a fixed range of gradation for the display unit. For example, an image display unit used for computer tomography can accommodate image data having gradation ranges from −1000 to +3000. A gradation range (called a window and level) that displays the states of individual sections most appropriately is selected according to the desired sections, and is displayed within the windows and levels of fixed gradation for the display unit. A gradation conversion circuit is built into the display device to match the selected range of image data gradation to that of the display device. Such image display devices as described above have conventionally required multiple gradation conversion circuits, which is not desirable due to increased hardware requirements when an operator wishes to display multiple sections on the same screen with each section displayed in a discrete range of gradation.

DISCLOSURE OF THE INVENTION

This new invention provides a display device that displays data in multiple areas of the same screen in discrete ranges of gradation while minimizing increased hardware requirements.

The image display device of this invention consecutively reads one frame of image data written to a first frame buffer (20) in during the display cycle of the display unit (80). The said display device writes image data each time to a write-enable area of a second frame buffer (50) as specified by a write control circuit (40) after gradation conversion processing is executed using a gradation conversion circuit (30). The image data of the second frame buffer is converted into a video signal by a video signal-generating circuit (70), and is displayed by the display unit (80). By repeatedly setting new gradations and write-enable areas, image data having discrete gradations for individual areas is written to the second frame buffer.

BRIEF DESCRIPTIONS OF THE DRAWINGS

BEST MODE FOR CARRYING OUT THE INVENTION

Application examples of this new invention are described in detail by referring to the following drawings.

Figure 1:
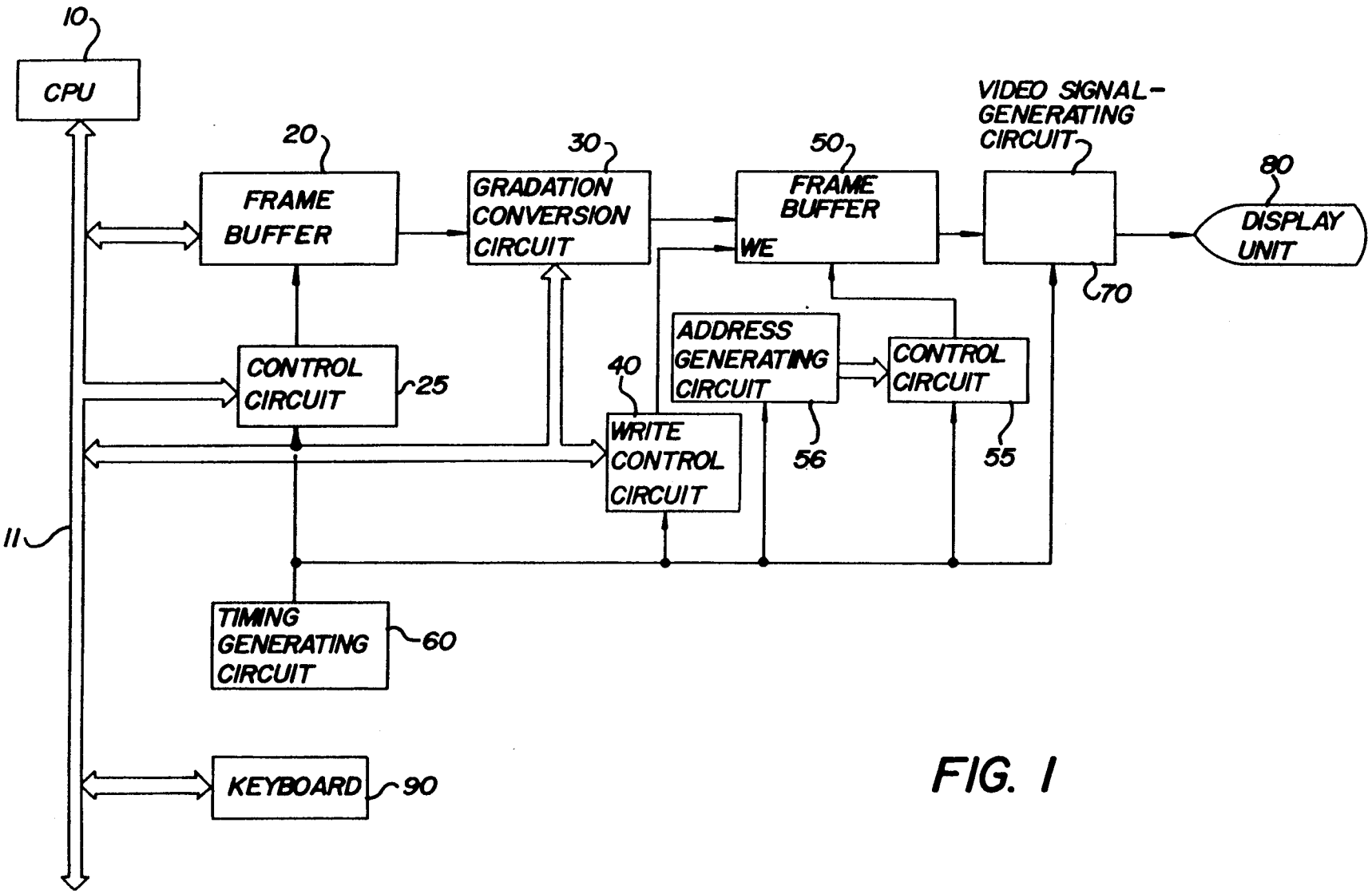
FIG. 1 shows the conceptual diagram of the preferred application mode of this new invention.

FIG. 1 shows a conceptual block diagram of the preferred application mode of this new invention.

In FIG. 1, the number 20 indicates the first frame buffer. Control circuit 25 of buffer 20, gradation conversion circuit 30, write control circuit 40, and keyboard 90 are connected to bus 11 of CPU 10, which generates image data to be displayed. Data and control signals are exchanged between these circuits and CPU 10.

CPU 10 supplies first frame buffer 20 with one frame of image data, and issues address and control signals to buffer control circuit 25 for controlling the read/write operations of first frame buffer 20. CPU 10 also sends gradation conversion control signals to gradation conversion circuit 30 and sends data for that specifies a write-enable are of second frame buffer 50 and other instructions to write control circuit 40. CPU 10 receives instructions from the operator through keyboard 90. The image data read from first frame buffer 20 is gradation-converted in gradation conversion circuit 30, and is sent to second frame buffer 50 as write data. An existing product, known as a window/level conversion circuit, may be used as gradation conversion circuit 40. Write control circuit 40 controls the write-enable/disable states of second frame buffer 50 while buffer control circuit 55 controls the read/write addresses and timing.

Buffer control circuit 55 receives an address signal from address-generating circuit 56.

Figure 2:
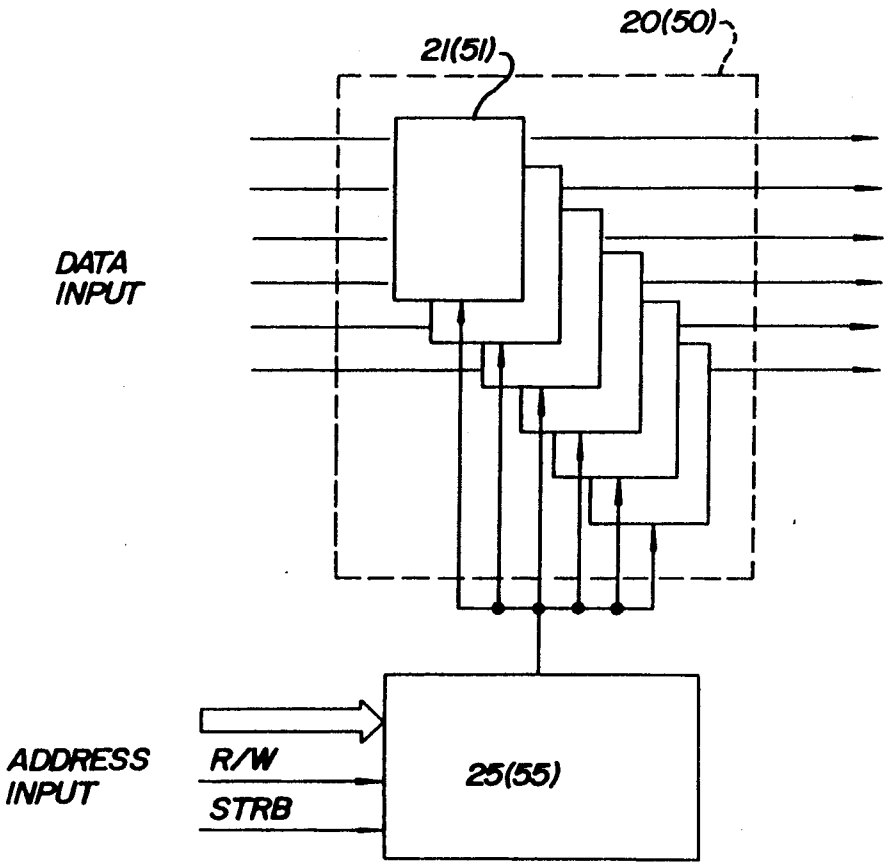
FIGS 2 and 3 show the individual circuit diagrams of the frame buffers of the preferred application mode.
Figure 3:
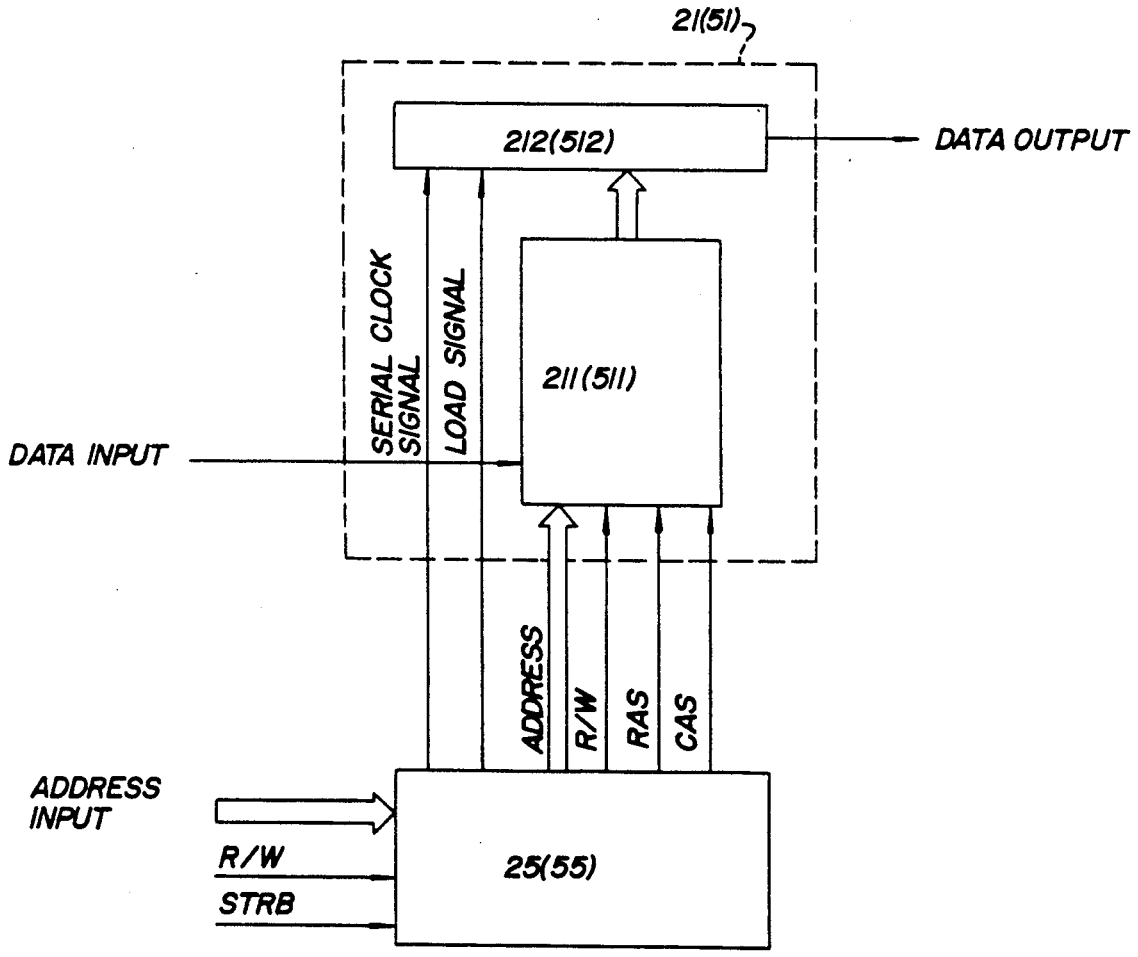

The image data read from second frame buffer 50 is converted into an analog video signal by video signal-generating circuit 70, then is sent to display unit 80 where an image is displayed. Timing signal generator 60 issues a timing signal corresponding to the display operation of display unit 80 to buffer control circuits 25 and 55, write control circuit 40, and address generating circuit 56. The timing signals generated by timing signal generator 60 include horizontal/vertical synchronous signals and dot timing signals (when a raster scan type of CRT display is used as display unit 80). First frame buffer 20 is repeatedly read frame-by-frame and second frame buffer 50 is repeatedly written to and read from in units of frames according to the generated timing signals. Frame buffer 20 is configured as shown in FIG. 2, for example, by using multiport RAM 21 in parallel for the number of image data bits. Frame buffer 50 is configured in a similar manner. Note that multiport 21 is a recently released video memory product. Multiport 21 (as shown in FIG. 3) combines conventional RAM 211 with shift registers. From RAM 211, data on a word line is selected by using a low-order address (for example, 256-bit data is read out at one time and loaded into shift register 212). Such data loaded into the said shift register is then output bit-by-bit in series. This enables CPU 10 to write or read image data to or from RAM 21 while shift register 212 outputs data.

Figure 4:
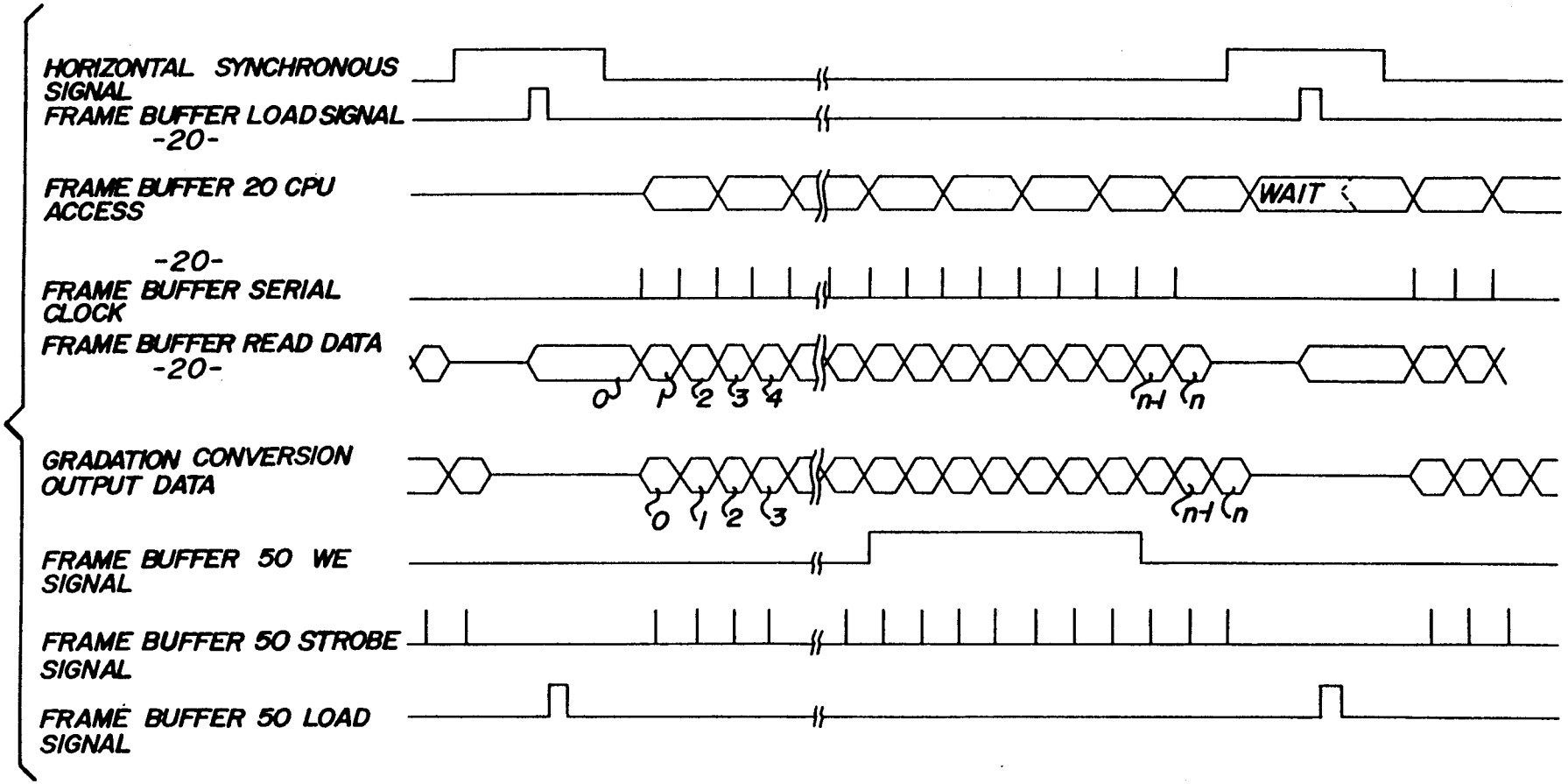

By using the functions of frame buffers, the gradations of multiple areas on a display screen can be discretely converted as follows:

FIG. 4 shows the operation of the device shown in FIG. 1 for one horizontal synchronous signal cycle. First frame buffer 20 is loaded when load signal is generated in synchronization with the horizontal signal with which data is read out from RAM 211 to shift register 212. The loaded data is output in series (according to a serial clock generated during a horizontal scanning period) as frame buffer read data. This data is then sent to gradation conversion circuit 30. During serial output, image data is written or read to and from RAM 211 during access by CPU 10.

Gradation conversion circuit 30 consecutively executes gradation conversion processing as specified by the data output in series, then the processed data is consecutively input to second frame buffer 50.

Gradation conversion circuit 30 inputs the image data in series to second frame buffer 50 after gradation conversion processing. The image data is then written consecutively to a write-enable area in RAM 511 as specified by write control circuit 40, and according to a strobe signal issued from control circuit 55. The write data is loaded into shift register 512 when a load signal is generated in synchronization with the following horizontal synchronous signal. The data is then output to video signal-generating circuit 70 according to a serial clock generated during the following horizontal scanning period.

Figure 5:
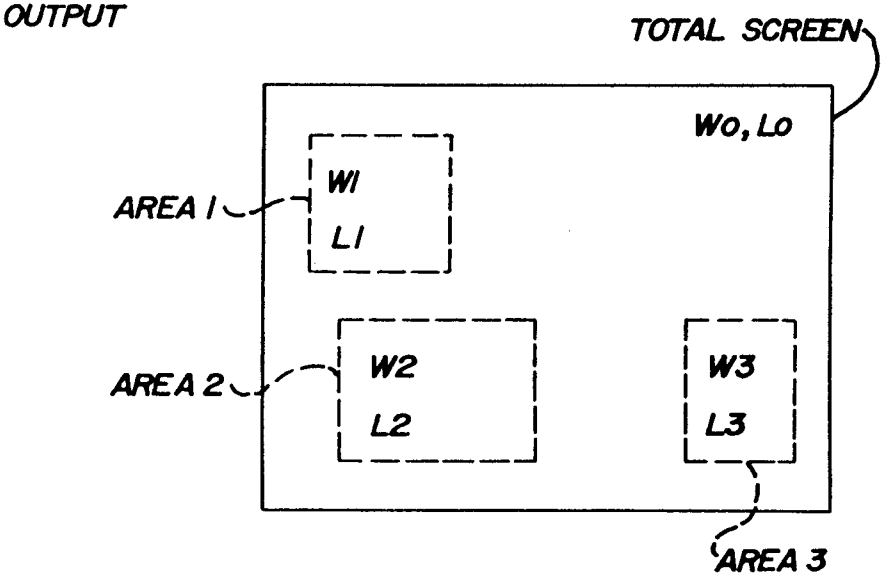
FIGS. 4 and 5 show the performance of the preferred application modes of this new invention.

The initial write-enable area specified by write control circuit 40 is for the total space of frame buffer 50. Consequently, the total screen area of display unit 80 is displayed at a certain gradation (WO, LO) as shown in FIG. 5. In other words, a window is displayed with WO and a level with LO.

To only display area 1 on the screen at a different gradation (Wl, Ll), an instruction specifying the area and the new gradation values must be input. Accordingly, CPU 10 sends gradation converting circuit 30 the values that specify a new gradation to gradation conversion circuit 30, and issues a signal to write control circuit 40 that specifies area 1. As a result, gradation conversion circuit 30 executes new gradation conversion processing for the image data from frame buffer 20, then outputs the data to frame buffer 50. Note that because the image data (after being newly processed for gradation conversion) is only written to area 1, which was write-enabled by write control circuit 40, only this area is reloaded. The display unit screen only displays the image data in area 1 at a different gradation (Wl, Ll) from the original (as shown in FIG. 5).

In the same way, multiple areas can be displayed at individual and different gradations by successively specifying the required areas and desired gradations. Such areas and gradations may be set by CPU 10 according to preprogrammed procedures, instead of having the operator perform this task using keyboard 90. Furthermore, frame buffers are not confined to multiport memory. Any other circuit having identical functions can be used instead.

We have described the best application mode for this new invention. This invention may be applied with ease in other specific forms by knowledgeable persons in applicable technical fields without departing from the spirit or essential characteristics of the following claims.

We claim:

1. An image display comprising:

a timing generating circuit;

a central control means;

a display screen having a plurality of areas thereon;

first buffer means comprising a first memory and a first shift register, and under the control of said central control means, for storing image data of at least one frame in said first memory and then for shifting the image data to the first shift register;

first means comprising a first control circuit connected to said timing generating circuit and under the control of said central control means, for cyclically and serially reading out in a timed sequence relative to timing from said timing generating circuit image data from said first shift register of said first buffer means and for causing another set of image data stored in said first memory to be shifted to the first shift register;

a single gradation conversion means under the control of said central control means for converting image data read out from said first shift register to desired gradation output signals;

second buffer means comprising a second memory and a second shift register for storing desired gradation output signals outputted from said single gradation conversion means in selected areas of said second memory corresponding to desired selected areas of said display screen, and then for shifting the stored desired gradation output signals to said second shift register;

write control means connected to said timing generating circuit and under the control of said central control means for selectively designating at a timed sequence relative to the timing generated by said timing generating circuit selected areas of said second memory in which selected desired gradation output signals from said single gradation conversion means are to be respectively stored;

second means comprising a second control circuit connected to said timing generating circuit for cyclically and serially reading out in a timed sequence relative to timing from said timing generating circuit gradation output signals from said second shift register and for causing another set of gradation output signals stored in said second memory to be shifted to the second shift register; and third means connected to said timing generating circuit for generating video signals in a timed sequence relative to timing from said timing generating circuit according to gradation output signals read out from said second shift register and for applying the video signals to said display screen to display images of desired gradations at specified respective areas of said screen; wherein said central control means selectively controls the first buffer means, the first means, the single gradation conversion means, and the write control means so that the ranges of the gradation output signals are compared in a timed sequence to the ranges of specified areas of the second memory corresponding to desired specified areas on the screen, and when the range are matched, desired gradation signals are shifted to the second shift register and then outputted to the third means, whereby corresponding video signals are applied to the display screen and images of desired gradations are thereby selectively and serially projected in a timed sequence relative to the timing generated by the timing generating circuit onto specified corresponding areas of said display screen with use of only a single gradation conversion means.

2. The display of claim 1 wherein the first buffer means and the second buffer means each comprise a multiport RAM.

* * * * *